United States Patent [19]

Freeman

[11] 4,141,617

[45] Feb. 27, 1979

[54] LIGHT FIXTURE

[75] Inventor: Jerry H. Freeman, Mt. Prospect, Ill.

[73] Assignee: Unarco Industries, Inc., Chicago, Ill.

[21] Appl. No.: 853,296

[22] Filed: Nov. 21, 1977

[51] Int. Cl.[2] ..... H01R 13/38

[52] U.S. Cl. ..... 339/97 L

[58] Field of Search ..... 339/95 D, 97 R, 97 L, 339/97 P, 99 L

[56] References Cited

U.S. PATENT DOCUMENTS

| | | | |
|---|---|---|---|
| 2,816,193 | 12/1957 | Pine | 339/97 R |
| 3,813,535 | 5/1974 | Freeman | 339/97 L |
| 3,936,127 | 2/1976 | Morrison | 339/97 L |

FOREIGN PATENT DOCUMENTS

| | | | |
|---|---|---|---|
| 2150208 | 4/1973 | Fed. Rep. of Germany | 339/95 D |

*Primary Examiner*—Joseph H. McGlynn

[57] ABSTRACT

An improved light fixture for mounting on a vehicle is disclosed. The fixture has connectors which can make electrical contact with a lead wire by pushing the loop of a lead through a lead aperture past the connector and then pulling the lead in the opposite direction so that the cutting edge of the connector interlocks the lead and makes electrical contact with the lead wire. The fixture is provided with means for holding the lead firmly in interlocking relationship with the fixture to insure that electrical contact is maintained.

9 Claims, 6 Drawing Figures

LIGHT FIXTURE

BACKGROUND OF THE INVENTION

In the past, light fixtures for installation on vehicles, such as trailers and mobile homes, were equipped with electrical components which had to be connected to the vehicle's wiring by conventional methods, such as by soldering or winding around screws. The use of such methods has proved to be inefficient, both in terms of requiring excess labor time, and also in failing to provide a satisfactory electrical connection.

U.S. Pat. No. 3,813,535 to Freeman discloses a fixture mounted on a vehicle which is provided with a different means for connecting an electrical lead. Basically, this includes an access opening in the base of the fixture. The access opening is divided by a partion that is configured to vary the width of each portion of the access opening. Connectors are provided on each side of the access opening, and each connector has a flexible leg and a cutting edge at the end of the leg, with each cutting edge extending about half way over each portion of the access opening. A loop of a lead is pushed through either side of the access opening and forces the flexible leg of the connector away from the partion. When the lead loop is pulled back, the cutting edge of the end of the leg of the connector pierces the lead insulation and makes electrical contact with the wire within the lead. Because the partion is configured to vary the width of each side of the access opening, this fixture can accomodate leads of different sizes.

SUMMARY OF THE INVENTION

An improved fixture for mounting on a vehicle is provided which has connectors which can make electrical contact with a lead wire by pushing a loop of a lead through a lead aperture past a connector and pulling the lead wire back so that the cutting edge of the connector pierces the lead insulation and makes electrical contact. The lead aperture of the fixture of the present invention is provided with a flange at its front end which bends the lead wire toward the cutting edge of the connector, and which provides an interlocking mechanism to hold the teeth of the electrical connector firmly in electrical contact with the lead wire. Thus, the lead wire is prevented from slipping in the rearward direction and coming out of contact with the teeth of the connector. In another aspect of this invention, the connectors are provided with improved teeth which make better electrical contact than is the case with the teeth of the connectors of the prior art fixtures.

Specifically, this invention provides a fixture for a light adapted to be mounted on a surface comprising an electrically insulative base member having a front side and rear side and defining a lead aperture therethrough. A substantially T-shaped wall member divides a lead aperture into two lead passages. It includes a shoulder portion disposed on the front side of the base and having a front face and a rear face, and a panel portion which is substantially narrower than the shoulder portion and is centered on and integral with the rear face of the shoulder portion and extends rearwardly and generally perpendicularly thereof. Each side of the rear face of the shoulder portion which extends outwardly of the panel portion defines a flange portion that performs two important functions as is described herein. A pair of electrical connectors, each having a free end portion overlying a portion of one of the lead passages is affixed to the base member at a point spaced from the free end of the connector. The free end of each connector defines three teeth adapted to pierce the insulation of a lead pulled rearwardly in one of the lead passages. Each of the free ends is capable of flexing away from the face in response to the insertion of a lead to each of the lead passages from the rear side of the base. When a lead is so inserted, it is deflected by the flange of the T-shaped wall member in the direction of the free end of the connector. When the lead is pulled rearwardly or back through the lead passage, it is forced onto the teeth of the connector by the flange so that the teeth of the connector pierce the insulation of the lead to make electrical contact with the wire therein, thus defining a point of electrical contact. The lead is pulled a sufficient distance so that the free end of the connector is forced passed the flange into an interlocking position. In this position, the flange portion of the T-shaped wall acts on the portion of the lead which is in front of the point of electrical contact with the connector in the direction of the connector. The spring action of the connector tends to force its free end and thus the lead wire in the direction of the flange portion of the T wall. Thus, the interaction of the connector and the flange member on opposite sides of the lead interlocks the lead into a stable position so that the cutting end of the connector remains in electrical contact with the wire and the lead.

THE DRAWINGS

DETAILED DESCRIPTION

Figures 1, 2, 3, 4, 5, 6:
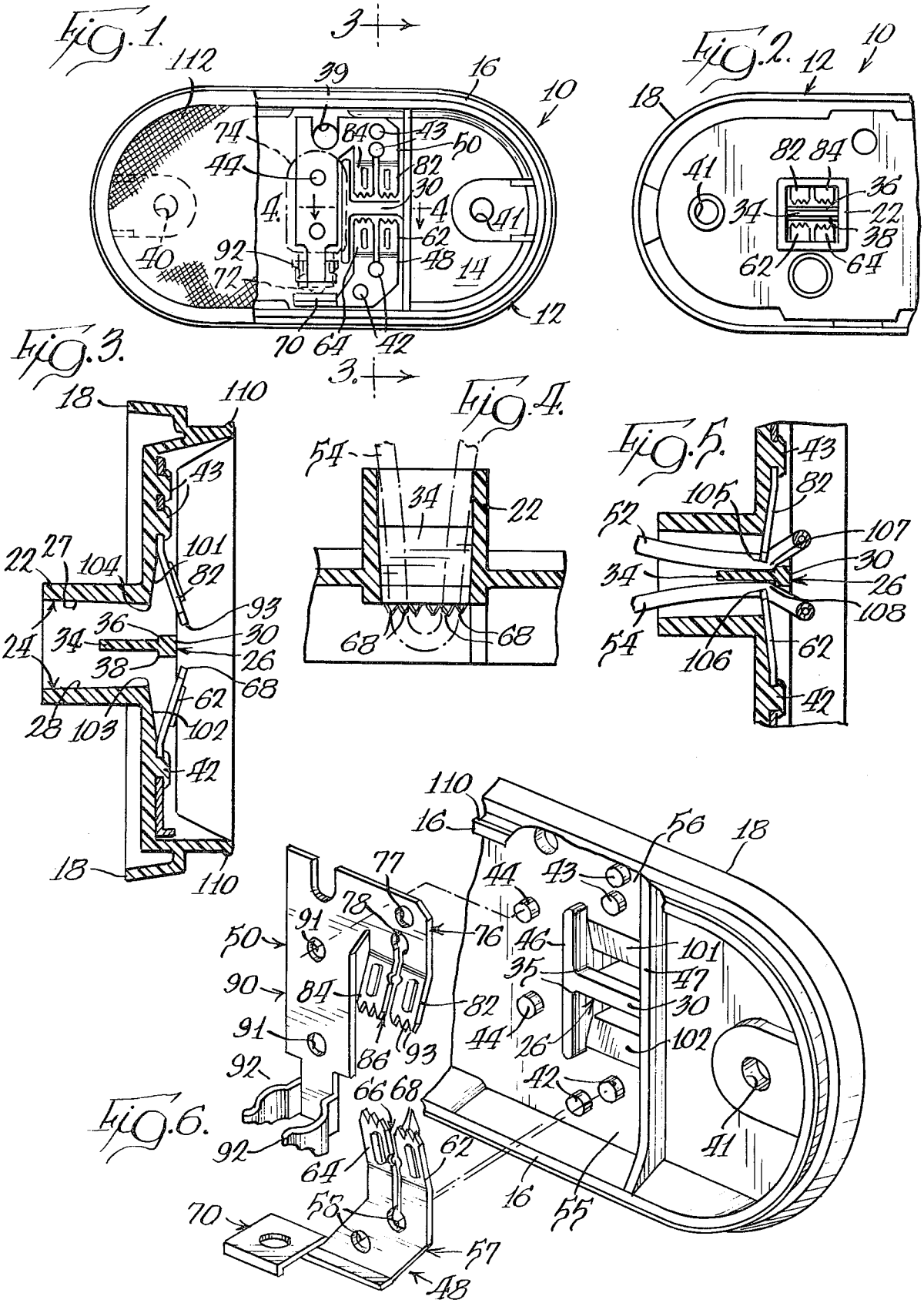
FIG. 1 is a plan view of the front portion of the fixture showing a cover mounted thereon, with the cover cut away to reveal the electrical connectors and light bulb disposed on the front face of the base of the fixture.
FIG. 2 is a fragmentary plan view showing the rear portion of the base of the fixture.
FIG. 3 is an enlarged cross-sectional view of the fixture taken along line 3—3 of FIG. 1.
FIG. 4 is an enlarged fragmentary cross-sectional view taken along line 4—4 of FIG. 1.
FIG. 5 is an enlarged fragmentary cross-sectional view showing the lead aperture of the fixture.
FIG. 6 is an exploded, fragmentary, perspective view of the front face of the fixture showing the relationship of the connectors to the lead aperture.

While this invention is susceptible of embodiment in many different forms, there is shown in the drawings and will herein be described in detail one specific embodiment, with the understanding that the present disclosure is to be considered as an exemplification of the principals of the invention and is not intended to limit the invention to the embodiment illustrated.

The fixture of the present invention is adapted to be easily secured as to the exterior surface of a mobile home, trailer, or other vehicle with minimum preparation of the vehicle for the fixture. The fixture may be attached to a surface by first cutting or punching a suitable hole in the surface through which a portion of the fixture base may be inserted and through which a lead wire may be drawn. The fixture 10 includes an electrically insulative base member 12 having a generally planar front side or face 14 and a peripheral rib 16 formed generally perpendicularly to the front face 14. The base member is illustrated as being elliptical in plan view, although it will be appreciated that the present invention is not limited to any particular shape, and that square, circular and other shapes may be used, as desired. The peripheral rib 16 includes a rearwardly extending outwardly offset spacer 18 adapted to engage the surface upon which the fixture is mounted. Caulking material may desirably be positioned between the surface on which the fixture is mounted and the back of front face 14 to provide a water-type seal.

The base member 12 is formed with an integral bushing 22 adapted to pass through a hole cut out in the mounting surface. The bushing 22 defines an opening for receiving a lead wire or a lead aperture opening 24. The lead aperture opening is divided in half by an integrally formed insulating T-shaped wall 26 to define lead passages 27 and 28 having substantially equal dimensions. The T-shaped wall 26 includes a shoulder portion 30 and a panel portion 34 which is integral with the rear face of shoulder portion 30. The panel portion 34 is narrower than the rear face of the shoulder portion 28 and is disposed on and integral with the rear face so that it extends rearwardly of the shoulder portion 30 to define a T. The corners 35 formed at the juncture of the T-shaped wall member and the base member are rounded to facilitate passage of the leads through the lead passages 27 and 28. Flange portions 36 and 38 are defined by the portions of the rear face which extend outwardly of the panel portion. These flange portions serve an important purpose in the operation of the fixture, as is discussed in more detail below.

The base member 12 includes suitable means such as holes 39, 40, and 41 for accomodating fastening means, such as screws (not shown) for attaching the fixture to a metal surface. Hole 39 is positioned to confront one of the connectors to ground that connector to a metal surface when screwed thereto, and holes 40 and 41 are remote from the connectors, thereby to guarantee proper grounding of the fixture and to assure proper polarity. The planar front face 14 also includes connector positioning means in the form of integrally formed posts 42, 43 and 44 and ribs 46 and 47 adjacent to and along the edges of the lead aperture 24.

A pair of connectors 48 and 50 are adapted to be positioned on the front face 14 for making electrical connection to the leads 52 and 54 inserted through the lead aperture 24. The connectors 48 and 50 are disposed in pockets 55 and 56 defined by ribs 46 and 47.

The hot lead connector 48, shown in FIG. 6, includes a lead connecting leg 57 having apertures 58 and 59 therein adapted to fit over positioning posts 42 which are adapted to receive a fastener such as a rivet or eyelet for securing the connector 48 to the base plate 12. Alternatively, the posts may be thermally deformed so that the tops of the posts melt over the aperture 58. Leg 57 of the connector 48 terminates at one end in a pair of fingers 62 and 64 formed by a slot 66 opening in aperture 59 extending along the center line of leg 56, thereby allowing each of the fingers 62 and 64 to flex independently of the other to accomodate different size leads. When in position as shown in FIG. 3, the ends of the fingers 62 and 64, which are formed with three insulation cutting teeth or serrations 68, overlie a portion, such as about one half, of the lead passage 28 to one side of the T-shaped wall member 26. The opposite end 70 of the connector 48 is formed substantially transversely of leg 56 and defines a contact adapted to engage the central contact 72 of a bulb 74 that is retained in position by the ground connector 50 as is shown in FIG. 1.

The ground connector 50 is a generally U-shaped member, having a lead engaging leg 76 generally similarly configured to leg 56 of the hot lead connector 48. Thus, the leg 76 of connector 50 includes apertures 77 and 78 adapted to fit over positioning post 43 and which may be secured thereto in any of the ways described in connection with posts 42. The connector leg 76 terminates in a pair of fingers 82 and 84 separated by an axial slot 86 (opening in aperture 78) which permits each of the fingers 82 and 84 to flex independently and to receive the lead inserted into lead passage 27.

The other leg 90 of the U-shaped connector 50 has apertures 91 to receive posts 44 for affixing it to the base plate in the same manner as with posts 42 and 43, and terminates at its free end in a bulb receiving clip 92 to receive the shank 94 of the light bulb 74 and to make electrical contact therewith, as seen in FIG. 1. When the light bulb 74 is positioned in bulb clip 92, the center contact 72 of the bulb 74 engages the bulb contact 70 of the hot lead connector 48 to complete the electrical circuit through the bulb.

The leads 52 and 534 are connected to each of the connectors 48 and 50 simply by inserting each lead 52 and 54 through the appropriate lead passage 27 or 28 of the lead aperture 24 and pushing each lead 52 and 54 past the respective teeth 68 and 93 of the fingers 62, 64, and 82, 84. As a lead 52 and 54 is pushed past the flange 36 and 38 on the shoulder portion 30 of the T-shaped wall 26, it is deflected in the direction of the end of its connector 48 and 50, and as it is pushed past the end of its connector, one or both of the fingers flex allowing the lead to pass. When a sufficient amount of lead has been inserted and forced past the connector, it is pulled back or rearwardly of the base, thus pulling the fingers toward the shoulder portion 30 and causing the teeth on the fingers to cut into the lead insulation. As the lead is drawn further back, the flange portion 36 or 38 pushes the lead against the teeth 68 and 78 as the fingers are drawn toward the flange, and as a result the teeth cut through the insulation until they make electrical contact with the wire. Preferably, the lead is pulled a sufficient distance so that the fingers are pulled across the flange to a position in which they are interlocked in electrical connection with the wire of the lead.

As can be seen from FIGS. 3 and 5, the front surfaces 101 and 102 of the front face 14 of the base which are adjacent lead passages 69 and 71 are angularly disposed with respect to the rest of the surface and terminate in corners 103 and 104.

The distance between corners 103 and 104 and flanges 36 and 38 define gaps which are of a sufficient size so that when a point of electrical contact 105 and 106 (FIG. 5) of a connector with the lead wire is disposed rearwardly of the flange 36 and 38, the section of the lead 107 and 108 between the point of electrical contact and the flange is interlocked by virtue of the spring force of the free end of the electrical connector acting through the lead against the flange 36 and 38. The angularly disposed surfaces 101 and 102 limit the angular deflection of the fingers which can be achieved by pulling the lead wire rearwardly of the flange. Preferably, these surfaces, which may or may not be angularly oriented depending on their distance from the flange portion 36 and 38 of the T-shaped wall, restrain the rearward movement of the fingers or the free ends of the connectors so that they are not bent totally beyond their elastic limits. Thus, when the fingers rest against the surfaces there is still an inherent spring action which tends to force the fingers in the forward direction toward the flange. In this manner, when the fingers are in electrical contact with the lead, and are pulled beyond the flange 36 or 38, the action of the flange on the insulation of the lead acts against the spring force of the free end of the fingers acting on the lead so that the lead is caught in a vise-like arrangement. In this manner, the fingers are prevented from moving in the rearward direction by the surface 101 and 102 and in the forward direction by the action of the flange on a lead wire so that the teeth of the fingers are interlocked in electrical connection with the wire and will not slip out of electrical connection therewith.

Preferably, leads 52 and 54 are inserted in loop form. This facilitates insertion and permits using wire runs which are continuous through two or more stations in the vehicle, saving time and labor in providing the electrical connection.

The peripheral rib 16 of base plate 12 incorporates a bead 110 to snap mount a typical cover 112 which protects the interior of the fixture and permits the light, when illuminated to be seen therethrough. In addition, a condensate escape passage may be provided by a narrow break in the bead 110 and by a slight relief in the main body of the rib 16 immediately below the break in the bead.

Thus, there has been disclosed a fixture which requires minimal preparation of a surface to which it may be attached, which permits ready assembly of the fixture itself and which permits rapid, simple, and reliable connection of leads to fixture connectors, thereby to complete an electrical circuit. Such fixtures are particularly useful for mounting light bulbs to external vehicle surfaces, although it will be apparent that they are adapted to other applications as well.

From the foregoing it will be apparent that variations and modifications may be effected without departing from the true spirit and scope of the invention. It is, of course, intended to cover by the appended claims all such modifications as followed in the scope of the claims.

I claim:

1. A fixture for a light adapted to be mounted on a surface comprising an electrically insulative base member having a front side and a rear side, said base member having a lead aperture therethrough, a substantially T-shaped wall member dividing said lead aperture to define two lead passages therethrough, said substantially T-shaped wall member including a shoulder portion disposed on the front side of said base and having a front face and a rear face and a panel portion narrower than the rear face of the shoulder portion integral with and centrally disposed on the rear face of said shoulder portion and extending rearwardly and generally perpendicular thereof, each side of the rear face of the shoulder portion which extends outwardly of the panel portion defining a flange portion, a pair of electrical connectors mounted on said front side of said base member, each having a free end portion overlying a separate portion of each lead passage and affixed to said base member at a point spaced from said free end, said free ends defining teeth disposed within said lead passages and adapted to pierce the insulation of a lead pulled rearwardly in said lead passages, each of said free ends flexing away from the front side of said base member in response to the insertion of a lead through each of said lead passages from the rear thereof, said leads being deflected in the direction of said free ends by said flange portions and each of the free ends being moved rearwardly of the rear face of said shoulder portion to pierce the insulation of said leads in response to said leads being pulled rearwardly in said lead passages and being forced onto said teeth by said flange portions to make electrical contact with the wire therein and defining a point of electrical contact.

2. The fixture of claim 1 wherein each of said free ends defines three teeth.

3. The fixture of claim 1 wherein each portion of the front side of the base adjacent each lead passage terminates in a corner, said corner spaced rearwardly from each flange portion of the shoulder to define a gap therebetween, said gap being of sufficient size so that the point of electrical contact may be disposed rearwardly of the flange portion with a section of the lead between the point of electrical contact and the flange portion interlocked therebetween by virtue of the spring force of the free end of the electrical connector acting through the lead against the flange.

4. The fixture of claim 1 wherein the front side of the electrically insulative base is substantially flat.

5. The fixture of claim 1 wherein an outer periphery of the electrically insulative base is substantially in the form of an ellipse.

6. The fixture of claim 1 wherein at least one rib is disposed on the front side of said electrically insulative base member, said at least one rib defining pockets, and said electrical connectors disposed in said pockets.

7. The fixture of claim 1 wherein each portion of the front side of the base adjacent each lead passage depends angularly from the front side in the rearward direction and terminates in a corner, said corner spaced rearwardly from each flange portion of the shoulder to define a gap therebetween, said gap being of sufficient size so that the point of electrical contact may be disposed readwardly of the flange portion with a section of the lead between the point of electrical contact and the flange portion interlocked therebetween by virtue of the spring force of the free end of the electrical connector acting through the lead against the flange.

8. The fixture of claim 1 wherein the T-shaped wall portion is substantially centrally located in said lead aperture so that the two lead passages have substantially equal dimensions.

9. The fixture of claim 8 wherein the two lead passages define corners at the juncture of the shoulder portion of the substantially T-shaped wall member with the electrically insulative base and said corners are rounded.

* * * * *